US008267379B2

(12) United States Patent
Yang et al.

(10) Patent No.: US 8,267,379 B2
(45) Date of Patent: Sep. 18, 2012

(54) CABLE GUIDING DEVICE

(75) Inventors: Huizhong Yang, Hang Zhou (CN); Zhaobo Qing, Hang Zhou (CN); Wei Bao, Hang Zhou (CN)

(73) Assignee: T-MAX (Hang Zhou) Industrial Co., Ltd. (CN)

( * ) Notice: Subject to any disclaimer, the term of this patent is extended or adjusted under 35 U.S.C. 154(b) by 289 days.

(21) Appl. No.: 12/831,687

(22) Filed: Jul. 7, 2010

(65) Prior Publication Data

US 2011/0168962 A1 Jul. 14, 2011

(30) Foreign Application Priority Data

Jan. 12, 2010 (CN) ..... 2010 1 0000569

(51) Int. Cl.
*B66D 1/36* (2006.01)

(52) U.S. Cl. ..... 254/336; 254/323; 254/327; 254/337; 254/392; 254/395

(58) Field of Classification Search ..... 254/383, 254/385, 323, 326, 329, 335, 336, 337, 390, 254/392, 393, 395
See application file for complete search history.

(56) References Cited

U.S. PATENT DOCUMENTS

| | | | | |
|---|---|---|---|---|
| 2,246,923 | A | 6/1941 | Meunier | |
| 3,407,011 | A * | 10/1968 | Zeidler | 384/54 |
| 3,784,165 | A | 1/1974 | Pruitt | |
| 3,899,093 | A * | 8/1975 | Allen | 254/415 |
| 3,985,047 | A * | 10/1976 | Therkelsen | 254/354 |
| 4,227,680 | A | 10/1980 | Hrescak | |
| 4,461,460 | A | 7/1984 | Telford | |
| 4,541,615 | A * | 9/1985 | King, Jr. | 254/134.3 FT |
| 4,545,567 | A | 10/1985 | Telford et al. | |
| 4,650,163 | A * | 3/1987 | Peterson | 254/327 |
| 4,736,929 | A | 4/1988 | McMorris | |
| 5,385,314 | A * | 1/1995 | Hughes | 242/397.3 |
| 5,398,923 | A | 3/1995 | Perry et al. | |
| 5,842,684 | A | 12/1998 | Aho | |
| 5,860,635 | A | 1/1999 | Morfitt et al. | |
| RE36,216 | E | 6/1999 | Telford | |
| 6,604,731 | B2 | 8/2003 | Hodge | |
| 6,631,886 | B1 * | 10/2003 | Caudle et al. | 254/327 |
| 6,663,086 | B2 | 12/2003 | Huang | |
| 6,672,568 | B1 * | 1/2004 | Rawlinson | 254/323 |
| 6,811,112 | B1 * | 11/2004 | Currie et al. | 242/534.1 |

(Continued)

FOREIGN PATENT DOCUMENTS

JP 54-8356 1/1979

*Primary Examiner* — Emmanuel M Marcelo
(74) *Attorney, Agent, or Firm* — Bliss McGlynn, P.C.

(57) ABSTRACT

A cable guiding device includes a base, upper and lower guide members disposed along a longitudinal direction, in which two ends of the upper guide member are mounted on the base and two ends of the lower guide member are mounted on the base. A slider defining a central cavity is penetrated therethrough in a lateral direction substantially perpendicular to the longitudinal direction. Upper and lower movable members are fitted slidably over the upper and lower guide members respectively, in which two ends of the upper movable member are mounted on two longitudinal side walls of the slider, and two ends of the lower movable member are mounted on two longitudinal side walls of the slider respectively. Upper and lower guiding rollers are fitted rotatably over the upper and lower movable members and disposed within the central cavity respectively.

10 Claims, 8 Drawing Sheets

U.S. PATENT DOCUMENTS

| | | | | |
|---|---|---|---|---|
| 6,983,927 | B2 * | 1/2006 | Pelletier et al. | 254/385 |
| 7,000,904 | B2 | 2/2006 | Huang | |
| 7,222,700 | B2 | 5/2007 | Elliott | |
| 7,374,153 | B2 | 5/2008 | Huang | |
| 7,380,742 | B2 * | 6/2008 | Stevens | 242/397.3 |
| 7,527,245 | B2 | 5/2009 | Lesko | |
| 7,614,609 | B1 | 11/2009 | Yang et al. | |
| 2003/0111654 | A1 | 6/2003 | Huang | |
| 2003/0230744 | A1 * | 12/2003 | Rawlinson | 254/323 |
| 2004/0069981 | A1 * | 4/2004 | Pelletier et al. | 254/385 |
| 2006/0175588 | A1 | 8/2006 | Lee | |
| 2007/0227835 | A1 | 10/2007 | Elliott | |
| 2008/0078981 | A1 | 4/2008 | Huang | |
| 2010/0102288 | A1 | 4/2010 | Yang et al. | |

* cited by examiner

CABLE GUIDING DEVICE

BACKGROUND OF THE INVENTION

1. Field of the Invention

The present invention generally relates to a cable guiding device, more particularly, and to a cable guiding device for a winch.

2. Description of the Related Art

A winch is a vehicle-carried apparatus mainly used for vehicle rescue, loading or unloading, which can be mounted on a vehicle such as an engineering vehicle, an off road vehicle, and SUV sports vehicle.

FIG. 8 shows a conventional cable guiding device 200. The conventional cable guiding device 200 comprises a base 203, an upper guiding roller 201 and a lower guiding roller 202 which are supported rotatably on the base 203 respectively. The cable guiding device 200 is generally disposed in front of a winch (not shown) in use, and the longitudinal direction of the cable guiding device 200 (i.e., the axial direction of the upper and lower guiding rollers 201 and 202) is substantially consistent with the axial direction of a drum of the winch. The free end of the cable is extended though a gap Ga between the upper and lower guiding rollers 201 and 202, so as to connect with an object to be dragged.

The conventional cable guiding device has at lease the following disadvantages. Firstly, the cable moves along the longitudinal direction (i.e., the axial direction of the drum) during winding or unwinding, so that the cable will move in the longitudinal direction relative to the upper and lower guiding rollers 201 and 202. Therefore, the lengths of upper and lower guiding rollers 201 and 202 should be adapted to the moving distance (i.e., the length of the drum in the axial direction thereof) of the cable in the longitudinal direction, so that the upper and the lower guiding rollers 201 and 202 are large in size, and the manufacturing thereof are difficult and high in cost. Secondly, the cable moves in the longitudinal direction relative to the upper and lower guiding rollers 201, 202 during winding and unwinding, so that sliding friction occurs in the longitudinal direction between the cable and the surface of the upper guiding roller 201 as well as the surface of the lower guiding roller 202. Therefore, the cable and the upper and lower guiding rollers are abraded, thus reducing the service lives thereof. Thirdly, the cable will be loose if no load is applied to the free end of the cable during winding of the cable onto the drum, so that the cable could not be wound tidily onto the drum, thus causing the cable to be in disorder, which results in damaging the cable, reducing the service life of the cable, and even damaging the winch.

SUMMARY OF THE INVENTION

The present invention overcomes at least one of the problems existing in the prior art. Accordingly, one embodiment of the present invention provides a cable guiding device that is small in size and low in cost, and the abrasion between the cable and the cable guiding device is decreased, thus prolong the service life of the cable and the cable guiding device.

The cable guiding device according to one embodiment of the present invention includes a base, an upper guide member disposed along a longitudinal direction, in which two ends of the upper guide member are mounted on the base respectively. A lower guide member is disposed parallelly under the upper guide member, and spaced apart from the upper guide member in a vertical direction. Two ends of the lower guide member are mounted on the base respectively. A slider defining a central cavity is penetrated therethrough in a lateral direction substantially perpendicular to the longitudinal direction. An upper movable member is fitted slidably over the upper guide member, in which two ends of the upper movable member are mounted on two longitudinal side walls of the slider respectively. An upper guiding roller is fitted rotatably over the upper movable member and disposed within the central cavity. A lower movable member is fitted slidably over the lower guide member, in which two ends of the lower movable member are mounted on two longitudinal side walls of the slider respectively, and a lower guiding roller is fitted rotatably over the lower movable member and disposed within the central cavity.

With the cabling guiding device of the present invention, the upper and lower guiding rollers are rotatable relative to the upper and lower movable members respectively, the upper and lower guiding rollers and the upper and lower movable members together with the slider are movable in the longitudinal direction relative to the upper and lower guide members respectively. Therefore, during the cable being wound onto and unwound from the drum, no sliding friction occurs between the cable and the upper guiding roller as well as the lower guiding roller in the circumferential and longitudinal directions of the upper and lower guiding rollers. The cable guiding device according to one embodiment the present invention may reduce abrasion of the cable and prolong service life of the cable. Therefore, with the cable guiding device according to the embodiment of the present invention, the lengths of upper and lower guiding rollers may be reduced, and the cost and the size of the cable guiding device may be reduced as well.

The above summary of one embodiment of the present invention is not intended to describe each disclosed embodiment or every implementation of the present invention.

Additional aspects and advantages of the embodiments of present invention will be given in part in the following description will become apparent in part from the following descriptions, or will be learned from the practice of the embodiments of the present invention.

BRIEF DESCRIPTION OF THE DRAWINGS

These and other aspects and advantages of the invention will become apparent and more readily appreciated from the following description taken in conjunction with the drawings, in which.

DETAILED DESCRIPTION OF EMBODIMENTS OF THE INVENTION

Figure 1:
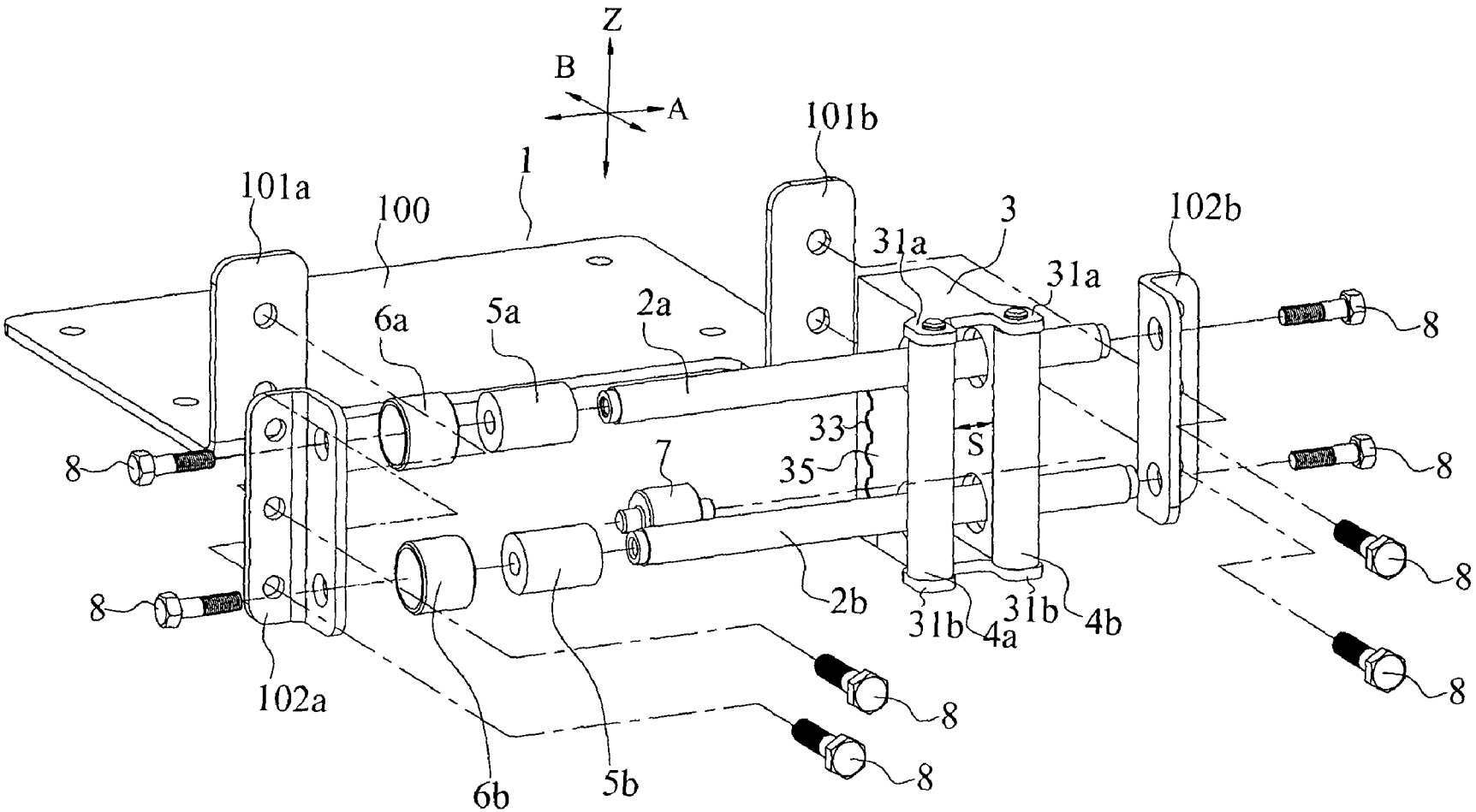
FIG. 1 is a schematic exploded view of the cable guiding device according to one embodiment of the present invention.

The cable guiding device according to one embodiment of the present invention will described in detail with reference to the drawings below. The embodiments described herein with reference to the drawings are explanatory, illustrative, and used to generally understand the present invention. The embodiments shall not be construed to limit the present invention. The same or similar elements and the elements having same or similar functions are denoted by like reference numerals throughout the descriptions.

In the description, relative terms such as "longitudinal", "lateral", "front", "rear", "right", "left", "lower", "upper", "horizontal", "vertical", "above", "below", "top", "bottom" as well as derivative thereof (e.g., "horizontally", "downwardly", "upwardly", etc.) should be construed to refer to the orientation as then described or as shown in the drawings under discussion. These relative terms are for convenience of description and do not require that the present invention be constructed or operated in a particular orientation. For instance, in the description below, direction A in FIG. 1 refers to a longitudinal direction, direction B refers to lateral direction, while direction Z refers to vertical direction.

Figure 5:
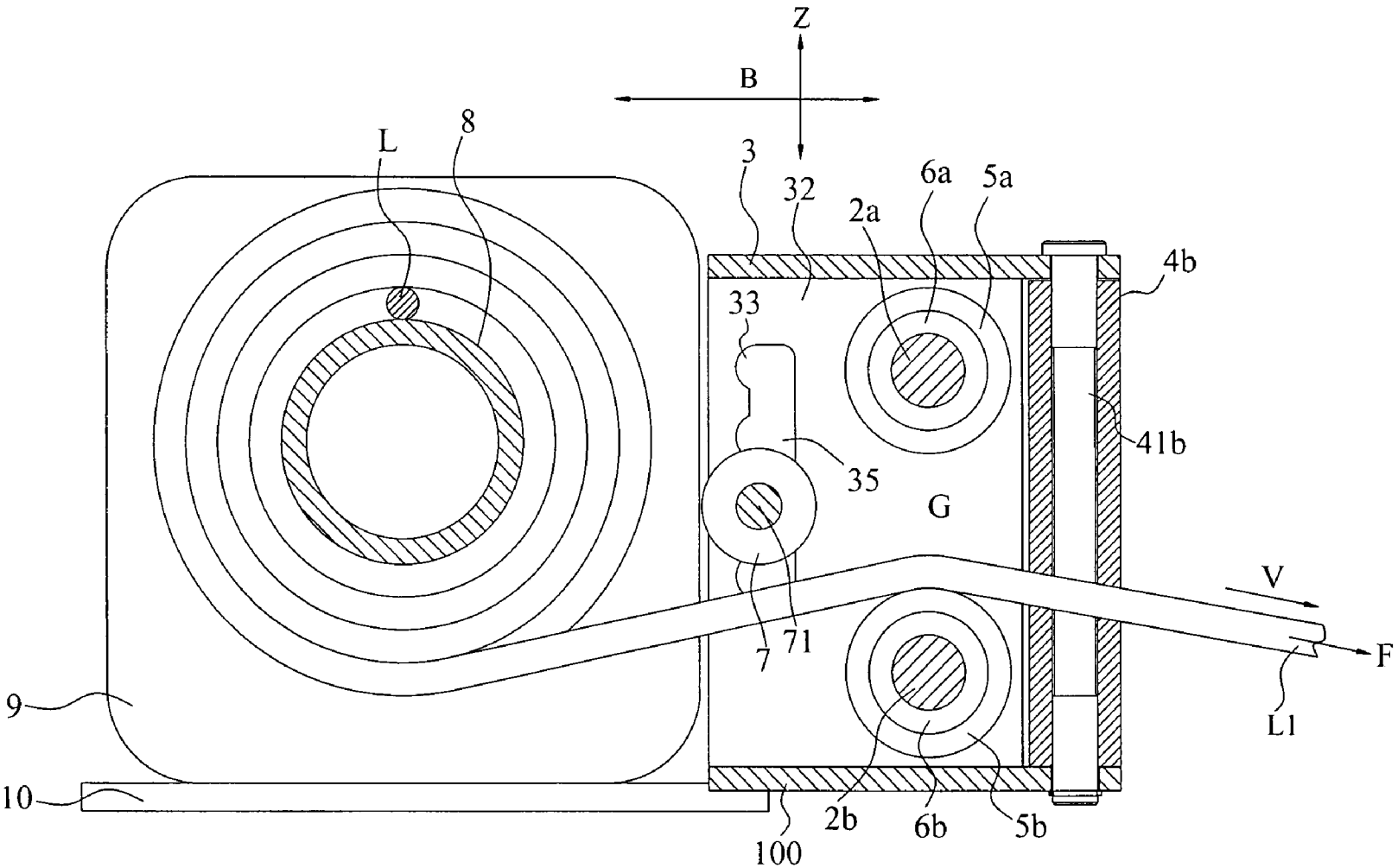
FIG. 5 is a schematic cross sectional view of the cable guiding device in a load state according to one embodiment of the present invention, in which the cable is being unwound from a drum of the winch and the cable-pressing roller is in the release position.
Figure 6:
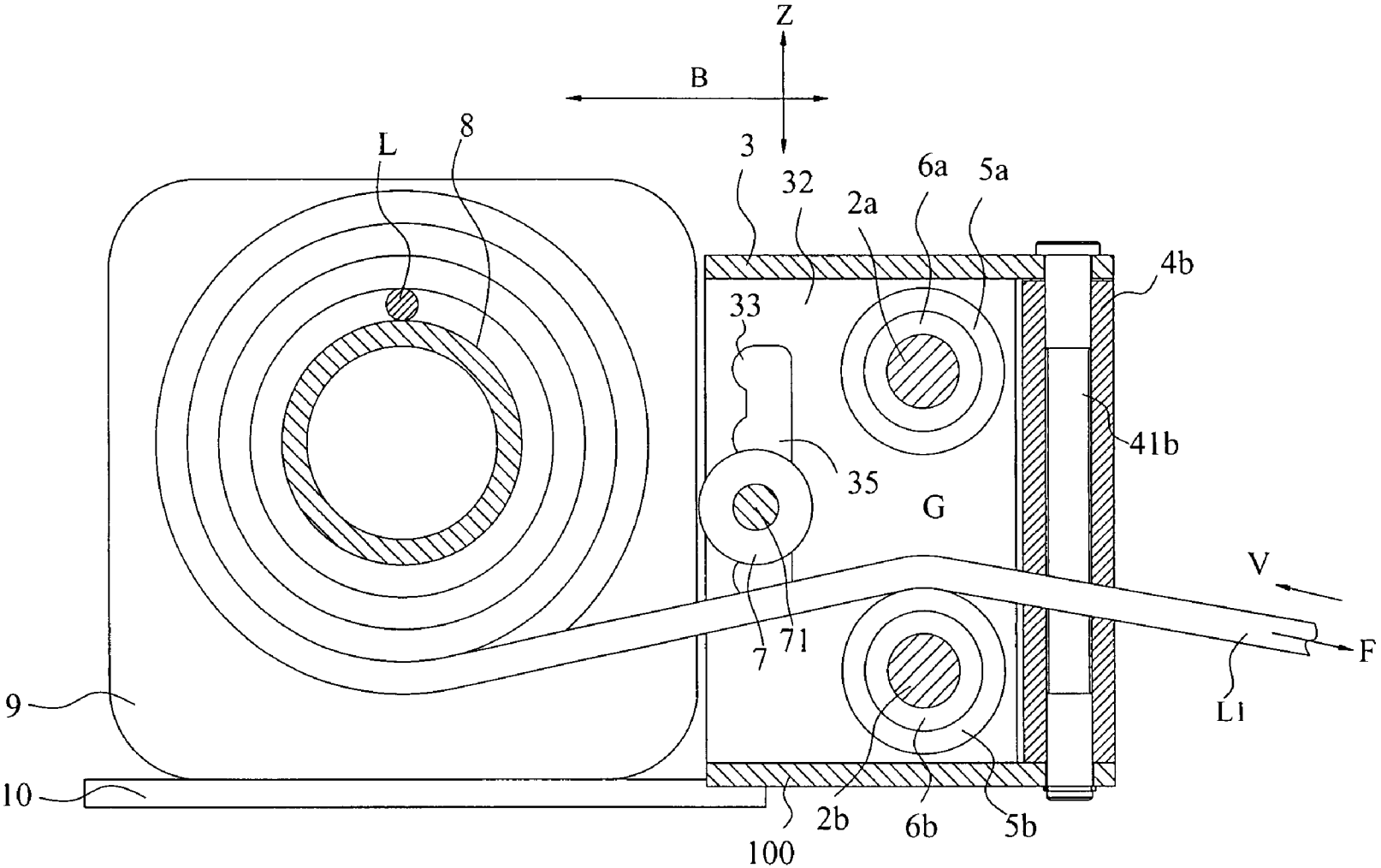
FIG. 6 is a schematic cross sectional view of the cable guiding device in a load state according to one embodiment of the present invention, in which the cable is being wound onto the drum of the winch and the cable-pressing roller is in a release position.

The term "load state" as used herein refers to a state of the cable guiding device in which the cable is wound onto or unwound from the drum of the winch with a load being applied to the free end of the cable, as shown in FIG. 5 and FIG. 6.

Figure 7:
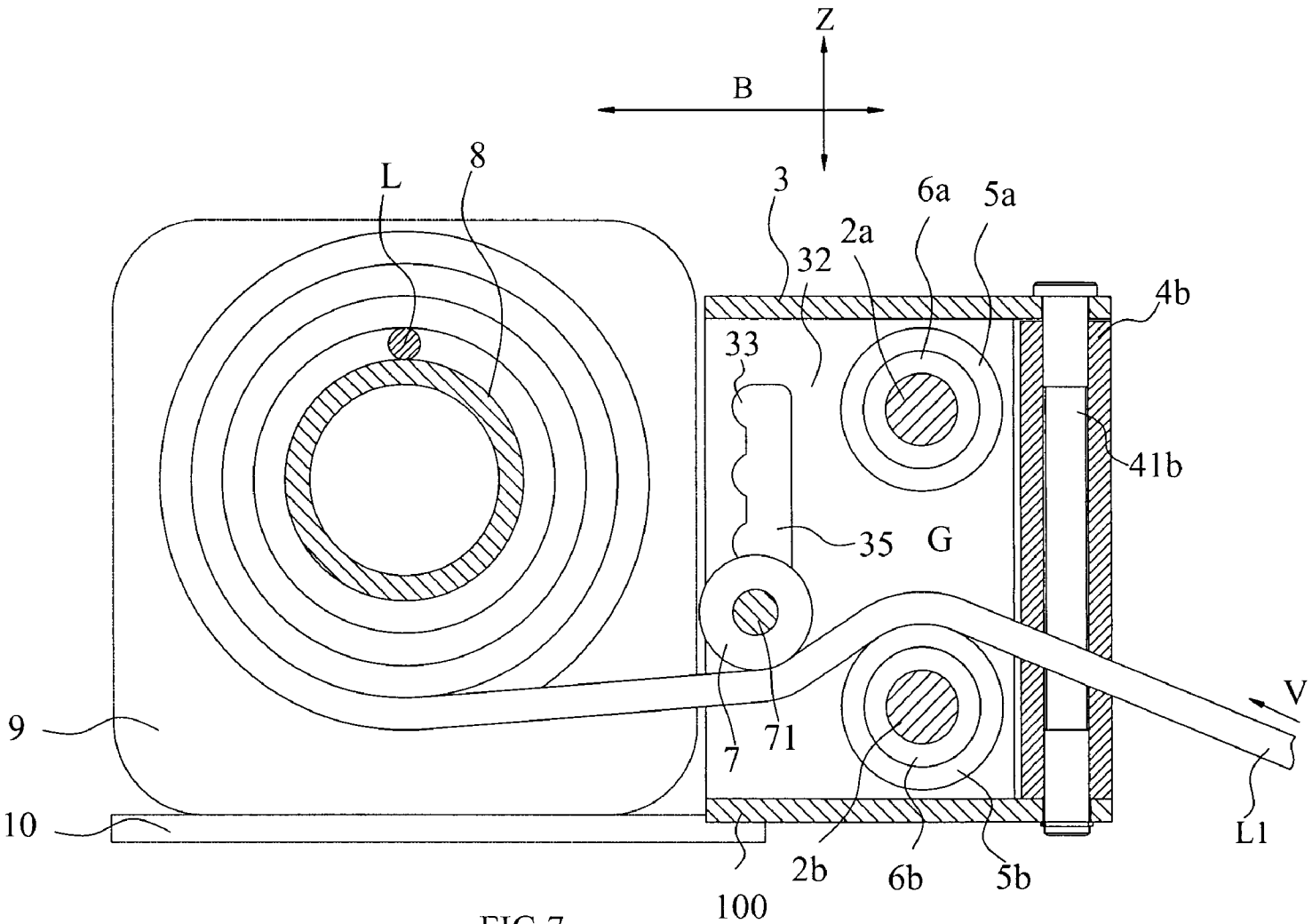
FIG. 7 is a schematic cross sectional view of the cable guiding device in a no-load state according to one embodiment of the present invention, in which the cable is being wound onto the drum of the winch and the cable-pressing roller is in a tension position.
Figure 8:
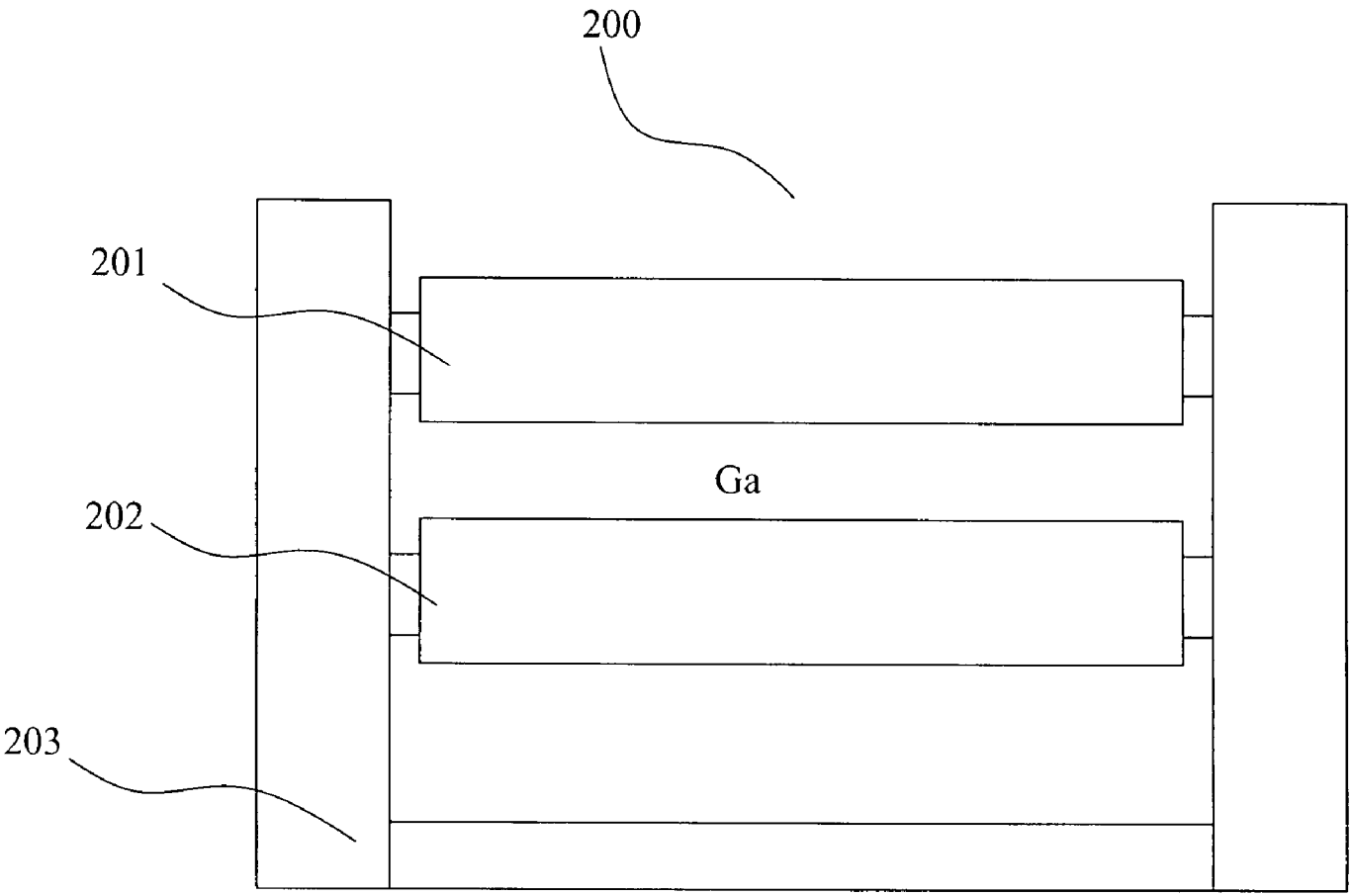
FIG. 8 is a schematic view of a conventional cable guiding device.

The term "no-load state" as used herein refers to a state of the cable guiding device in which the cable is wound onto the drum of the winch with on load being applied to the free end of the cable, as shown in FIG. 7.

The term "tension position" as used herein refers to a position of the cable-pressing roller in which the cable is tensioned by the cable-pressing roller in the no-load state, as shown in FIG. 7.

The term "release position" as used herein refers to a position of the cable-pressing roller in which the cable-pressing roller releases the cable and thereby the cable is not tensioned in the load state, as shown in FIG. 5 and FIG. 6.

Figure 2:
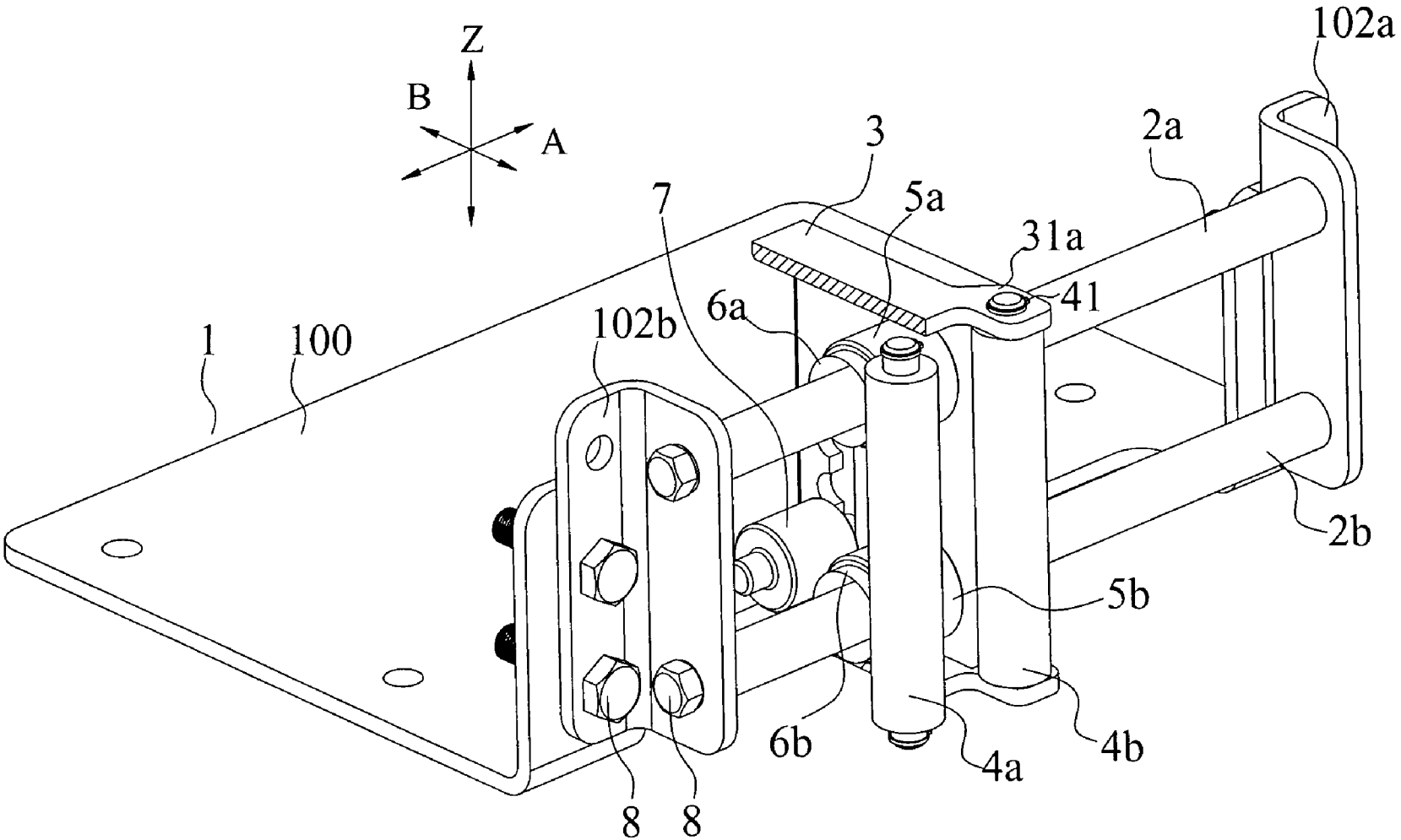
FIG. 2 is a schematic partial sectional view of the cable guiding device according to one embodiment of the present invention.
Figure 3:
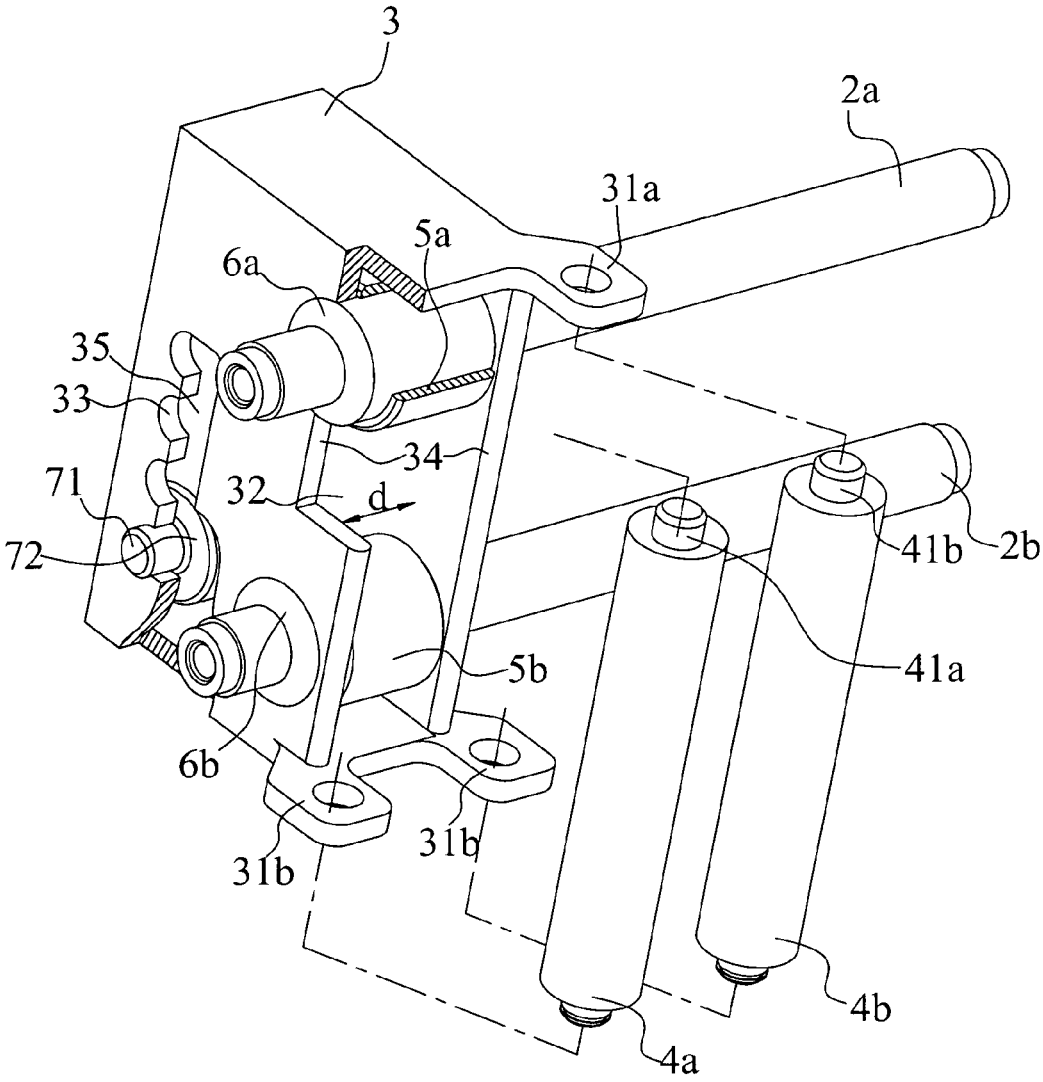
FIG. 3 is a schematic partial sectional view of the cable guiding device in a assembly state according to one embodiment of the present invention, in which the base is not illustrated.

As shown in FIGS. 1-3, the cable guiding device according to one embodiment of the present invention includes a base 1, an upper guide member 2*a*, a lower guide member 2*b*, a slider 3, an upper movable member 5*a*, an upper guiding roller 6*a*, a lower movable member 5*b* and a lower guiding roller 6*b*. Each of these components will be described in greater detail below.

The upper and lower guide members 2*a* and 2*b* are disposed along a longitudinal direction A respectively, so that the axial directions of the upper guide member 2*a* and the lower guide member 2*b* are substantially consistent with the longitudinal direction A. In other words, the upper and lower guide members 2*a* and 2*b* are parallel to each other. More specifically, two ends of the upper guide member 2*a* are mounted on the base 1 respectively, and two ends of the lower guide member 2*b* are mounted on the base respectively as well, in which the lower guide member 2*b* is disposed under the upper guide member 2*a*. The lower guide member 2*b* is spaced apart from the upper guide member 2*a* in a vertical direction Z (i.e., the up and down direction as viewed in FIG. 1), so that a gap G for passing the cable L is formed between the upper and lower guide members 2*a* and 2*b*, as shown in FIG. 3.

In some embodiments of the present invention, each of the upper and lower guide members 2*a* and 2*b* may be a circular column. In the examples of shown in FIGS. 1-3, the axes of the upper and lower guide members 2*a* and 2*b* are in the same vertical plane. In other words, the upper guide member 2*a* is aligned with the lower guide member 2*b* in the vertical direction.

As shown in FIGS. 1-2, in one example of the present invention, the base 1 comprises a mounting plate 100, a first extending frame 101*a* and a second extending frame 101*b*. When the cable guiding device is disposed in front of the winch 9 (as shown in FIGS. 4-7), the mounting plate 100 may be connected to the base plate 10 of the winch 9. The first and second extending frames 101*a* and 101*b* are extended upwardly in the vertical direction Z from the mounting plate 100 respectively and spaced apart from each other in the longitudinal direction A. The distance between the first extending frame 101*a* and the second extending frame 101*b* in the longitudinal direction A is determined such that two ends of each of the upper and lower guide members can be mounted on the first and second extending frames 101*a* and 101*b* respectively.

The first and second extending frames 101*a* and 101*b* may be integrated with the base 100. For example, each of the first and second extending frames 101*a* and 101*b* is formed by bending a part of the base 100. Of course, the present invention is not limited to this embodiment. For example, the first extending frame 101*a* and the second extending frame 101*b* may be made separately, then welded or connected via bolt to the base 100.

In some embodiments of the present invention, the cable guiding device further includes a first support frame 102*a* and a second support frame 102*b*, which are mounted on the first and second extending frames 101*a* and 101*b* respectively via bolts 8, as shown in FIGS. 1 and 2. The first and second support frames 102*a* and 102*b* each have a substantially L shape respectively, in which two ends of each of the upper and lower guide members 2*a* and 2*b* are mounted on the first and second support frames 102*a* and 102*b* respectively. More specifically, a threaded hole is formed at two ends of each of the upper and lower guide members 2*a* and 2*b*, and two ends of each of the upper and lower guide members 2*a* and 2*b* are mounted on the first and second support frames 102*a* and 102*b* respectively via bolts 8. The upper and lower guide members 2*a* and 2*b* can be mounted or dismounted more conveniently by providing the first and second support frames 102*a* and 102*b*.

The slider 3 defines a central cavity 32 penetrated therethrough in the lateral direction B substantially perpendicular to the longitudinal direction A. In other words, two longitudinal side walls of the slider (i.e., front and rear surfaces thereof as shown in FIG. 3, or right and left surfaces thereof as shown in FIG. 5) are open, so that the cable L may be extended through the slider 3 in the lateral direction B. As shown in FIGS. 1-3 and 5-7, the slider 3 has a parallelepiped shape, and the front and back walls are cut off, so that a central cavity 32 penetrated therethrough in the lateral direction B is formed.

In one example of the present invention, the cable guiding device includes a left guiding roller 4*a* and a right guiding roller 4*b*. The upper and lower ends of each of the left and right guiding rollers 4*a* and 4*b* are mounted on the top and bottom walls of the slider 3 respectively. Each of the left and right guiding rollers 4*a* and 4*b* is rotatable around an axis thereof. The left and right guiding rollers 4*a* and 4*b* are spaced a predetermined distance S apart from each other in the longitudinal direction A, and disposed in front of the upper and lower guide members 2*a* and 2*b* in the lateral direction B. The predetermined distance S is equal to or smaller than the longitudinal size d of the central cavity 32 of the slider 3. Consequently, the cable L is guided from two sides in the longitudinal direction A by the left and right guiding rollers 4*a* and 4*b*, thus avoiding contacting and abrasion between of the cable L and each of the two longitudinal side walls 34 of the slider 3.

In some embodiments of the present invention, two first lugs 31*a* are formed on the front side (the right side in FIGS. 5-7) of the top wall of the slider 3, extended forwardly in the lateral direction B, and spaced apart from each other in the longitudinal direction A. Similarly, two second lugs 31*b* are formed on a front side of the bottom wall of the slider 3, extended forwardly in the lateral direction B, spaced apart from each other in the longitudinal direction A, and correspond to the two first lugs 31*a* in the vertical direction Z respectively. The upper ends of the left and right guiding rollers 4*a* and 4*b* are rotatably mounted on the two first lugs 31*a*, and the lower ends of the left and right guiding rollers 4*a* and 4*b* are rotatably mounted on the two second lugs 31*b*, respectively.

As shown in FIGS. 1-3, each of the left and right guiding rollers 4*a* and 4*b* comprises a central shaft and an external sleeve fitted rotatably over the central shaft. The upper and lower ends of the central shaft are extended out from holes formed in the first lugs 31*a* and the second lugs 31*b*, respectively, then fixed via retainer rings 41 and nuts (not shown). Of course, the present invention is not limited to the embodiment of the present invention described in detail above. For example, the upper and lower ends of each of the left and right guiding rollers 4*a* and 4*b* may be mounted rotatably in the first lugs 31*a* and the second lugs 31*b* via bearings respectively.

As shown in FIGS. 1 to 3, it will be appreciated by those skilled in the art that the first lugs 31*a* and the second lugs 31*b* are extended forwardly in the lateral direction B and exceed the upper and lower guide members 2*a* and 2*b*, respectively. Therefore, when mounted on first lugs 31*a* and the second lugs 31*b* respectively, the left and right guiding rollers 4*a* and 4*b* are located in front of the upper guide member 2*a* and the lower guide member 2*b* in the lateral direction B.

As shown in FIGS. 1-3, two ends of the upper movable member 5*a* are mounted on the two longitudinal side walls 34 of the slider 3 respectively. The upper movable member 5*a* is fitted slidably over the upper guide member 2*a*. In one example of the present invention, the upper movable member 5*a* comprises a linear bearing which is slidable in the longitudinal direction A relative to the upper guide member 2*a*.

Two ends of the lower movable member 5*b* are mounted on two longitudinal side walls 34 of the slider 3 respectively. The lower movable member 5*b* is fitted slidably over the lower guide member 2*b*. In one example of the present invention, the lower movable member 5*b* comprises a linear bearing which is slidable in the longitudinal direction A relative to the lower guide member 2*b*.

The upper guiding roller 6*a* is disposed within the central cavity 32 of the slider 3 and fitted rotatably over the upper movable member 5*a*. The lower guiding roller 6*b* is disposed within the central cavity 32 of the slider 3 and fitted rotatably over the lower movable member 5*b*.

Therefore, when being wound onto or unwound from the drum 8, the cable L is guided by the upper guiding roller 6*a* and the lower guiding roller 6*b*. Thus no sliding friction occurs in both longitudinal and circumferential directions between the cable L and the upper guide roller 6*a* as well as the lower guiding roller 6*b*.

As shown in FIGS. 1-3, In some embodiments of the present invention, the upper and lower guiding rollers 6*a* and 6*b* and the upper and lower movable members 5*a* and 5*b* together with the slider 3 are movable in the longitudinal direction A relative to the upper and lower guide members 2*a* and 2*b* respectively. At the same time, the upper and lower guiding rollers 6*a* and 6*b* are rotatable relative to the upper and lower movable members 5*a* and 5*b*, respectively.

Therefore, when being wound onto or unwound from the drum 8 of the winch 9, the cable L moves in the longitudinal direction A, thus driving the upper and lower movable members 5*a*, 5*b* as well as the upper and lower guiding rollers 6*a*, 6*b* together with the slider 3 to move in the longitudinal direction A relative to the upper and lower guide members 2*a* and 2*b*. At the same time, the upper and lower guiding rollers 6*a*, 6*b* rotate relative to the upper and lower movable members 5*a*, 5*b* respectively, and the left and right guiding rollers 4*a* and 4*b* may rotate and simultaneously translate together with the slider 3. Consequently, no sliding friction occurs between the cable L and each of the upper and lower guiding rollers 6*a*, 6*b* in both longitudinal and circumferential directions, and between the cable L and each of two longitudinal side walls 34 of the slider 3. Therefore, the length of each of upper and lower guiding rollers 6*a* and 6*b* is reduced, the size of the cable guiding device is reduced, the cost of the cable guiding device is low, the abrasion of the cable L is decreased, and the service life of the cable L is prolonged. Furthermore, the cable guiding device according to embodiments of the present invention does not need power apparatus to drive the upper and lower guiding rollers 6*a* and 6*b*, the left and right guiding rollers 4*a* and 4*b* and the slider 3, thus simplifying the structure of the cable guiding device.

As shown in FIGS. 1-3, the cable guiding device according to another embodiment of the invention further includes a cable-pressing roller 7 rotatably mounted in the central cavity 32 of the slider 3 in the longitudinal direction A. The cable-pressing roller 7 is movable between a tension position at which the cable-pressing roller tensions the cable L and a release position at which the cable-pressing roller release the cable L.

In some embodiments of the invention, the cable-pressing roller 7 comprises a center shaft 71 and a sleeve 72 fitted rotatable over the center shaft 71. A vertical groove 35 is formed in each of the two longitudinal side walls 34 of the slider 3, and two ends of the first center shaft 71 of the cable-pressing roller 7 are supported in the vertical grooves 35 respectively. The sleeve 72 is disposed within the central cavity 32 of the slider 3. As shown in FIGS. 1-3 and FIGS. 5-7, a plurality of recesses 33 are formed in a side wall of each vertical groove 35 in the lateral direction B, and spaced apart from one another in the vertical direction Z. Two ends of the cable-pressing roller 7 are supported and held in the recesses 33 respectively when the cable-pressing roller 7 is in the tension position and the release position.

In some embodiments of the invention, when two ends of the cable-pressing roller 7 are held in the two downmost recesses 33 as shown in FIG. 7, the cable-pressing roller 7 is in the tension position. Therefore, when the cable guiding device is in the no-load state, that is, there is no load applied to the free end of the cable L, the cable L is tensioned by the cable-pressing roller 7 while being wounded onto the drum 8, thus preventing the cable L from loosing and being in disorder.

Figure 4:
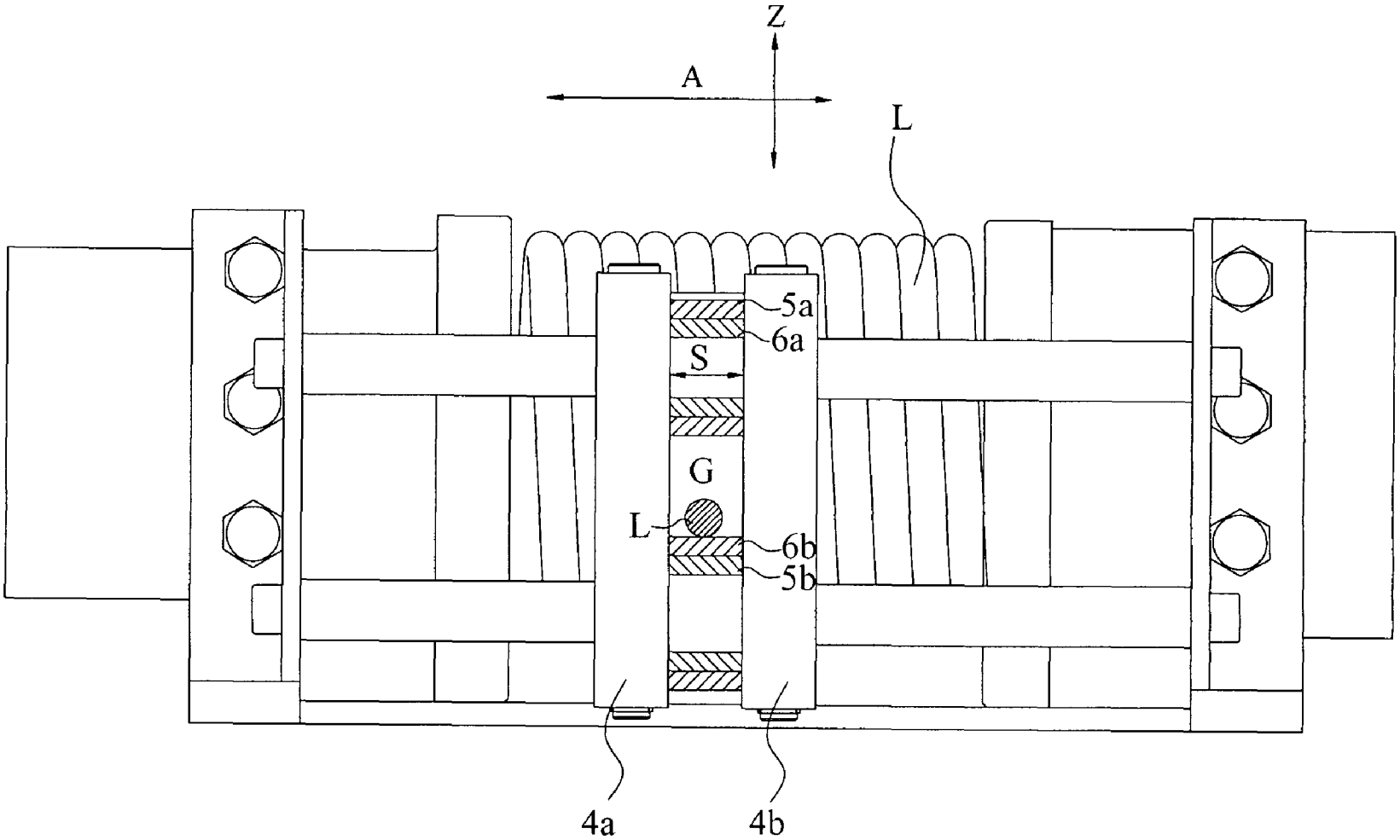
FIG. 4 is a schematic view of the cable guiding device according to one embodiment of the present invention positioned in front of a winch.

When the cable guiding device is in the load state, that is, there is a load F applied to the free end of the cable L, as shown in FIGS. 5 and 6, the cable-pressing roller 7 moves upwardly under the driving of the cable L during the cable L is wound onto or unwound from the drum 8. The cable-pressing roller 7 is held in the release position when two ends of the cable-pressing roller 7 are held in two upper recesses 33. As shown in FIGS. 4-6, there are one tension position and two release positions of the cable-pressing roller 7. However, it should be appreciated by those skilled in the art that the present invention is not limited to this embodiment. When two ends of the cable-pressing roller 7 are held in the recesses 33, whether the cable-pressing roller 7 is in the tension position or the release positions, depends on whether the cable L is needed to be tensioned by the cable-pressing roller 7. In this way, the cable-pressing roller 7 is in the tension position if the cable L is tensioned by the cable-pressing roller 7, otherwise it is in the release positions. The operation and use of the cable guiding device according to embodiments of the invention will be described below.

As shown in FIGS. 4 to 7, in use, the cable guiding device is generally disposed in front of the winch 9, and the mounting plate 100 thereof is connected to the base 10 of the winch 9.

As shown in FIG. 4, the cable L is extended through a space surrounded by the upper guiding roller 6*a*, the lower guiding roller 6*b*, the left guiding roller 4*a* and the right guiding roller 4*b*, so that the cable L can be guided from four sides, i.e. the upper side, the lower side, the left side, and the right side.

As shown in FIG. 5, the cable guiding device is in the load state and the cable L is being unwound from the drum 8. In other words, the load F is applied to the free end of the cable L, and the cable L is being unwound from the drum 8 in the direction denoted by arrow V as shown in FIG. 5. In this case, the cable-pressing roller 7 is in the release position such that the cable L is not tensioned by the cable-pressing roller 7. When the cable L is unwound from the drum 8, the upper and lower guiding rollers 6*a* and 6*b* move together with slider 3 in the longitudinal direction A (right and left direction in FIG. 4) and simultaneously rotate relative to the upper and lower guide members 2*a* and 2*b* respectively under the driving of the cable L. Similarly, the left guiding roller 4*a* and the right guiding roller 4*b* move together with the slider 3 in longitudinal direction A and rotate around their axes thereof respectively. Consequently, no sliding friction occurs between the cable L and each of the upper and lower guiding rollers 6*a* and 6*b* in both longitudinal and circumferential directions, and between the cable L and each of two longitudinal side walls 34 of the slider 3.

As shown in FIG. 6, the cable guiding device is in the load state and the cable L is being wound onto the drum 8. In other words, the load F is applied to the free end of the cable L, and the cable L is being wound onto the drum 8 in the direction denoted by arrow V as shown in FIG. 6. In this case, the cable-pressing roller 7 is in the release position. When being wound onto the drum 8, the cable L is guided by the upper guiding roller 6*a*, the lower guiding roller 6*b*, the left guiding roller 4*a* and the right guiding roller 4*b*.

As shown in FIG. 7, the cable guiding device is in the no-load state and the cable L is being wound onto the drum 8. In other words, there is no load applied to the free end of the cable L. In this case, the cable-pressing roller 7 is in the tension position, so that the cable L is tensioned by the cable-pressing roller 7. Therefore, when being wounded onto the drum 8, the cable L is tensioned by the cable-pressing roller 7, so that the cable L can be wound and arranged tidily onto the drum 8 and prevented from being in disorder.

Thus, with the cable guiding device according to embodiments of the invention, the upper and lower guiding rollers 6*a* and 6*b*, and the left and right guiding rollers 4*a* and 4*b* may rotate and simultaneously move together with the slider 3 relative to the upper and lower guide members 2*a* and 2*b* under driving of the cable L. Therefore, the lengths of the upper and lower guiding rollers 6*a* and 6*b* may be reduced, the size of the cable guiding device be reduced, the abrasion of the cable L may be decreased, and the service life of the cable may be prolonged. Furthermore, the cable guiding device according to embodiments of the present invention does not need power apparatus to drive the upper and lower guiding rollers 6*a* and 6*b*, the left and right guiding rollers 4*a* and 4*b* and the slider 3, thus further simplifying the structure thereof and reducing the cost.

Although explanatory embodiments have been shown and described, it should be appreciated by those skilled in the art that changes, alternatives, and modifications can be made in the embodiments without departing from spirit and principles of the invention. Such changes, alternatives, and modifications all fall into the scope of the claims and their equivalents.

What is claimed is:

1. A cable guiding device, comprising:

a base, an upper guide member disposed along a longitudinal direction, in which two ends of the upper guide member are mounted on the base respectively, a lower guide member disposed parallelly under the upper guide member and spaced apart from the upper guide member in a vertical direction, in which two ends of the lower guide member are mounted on the base respectively, a slider defining a central cavity penetrated therethrough in a lateral direction substantially perpendicular to the longitudinal direction, an upper movable member fitted slidably over the upper guide member, in which two ends of the upper movable member are mounted on two longitudinal side walls of the slider respectively, an upper guiding roller fitted rotatably over the upper movable member and disposed within the central cavity, a lower movable member fitted slidably over the lower guide member, in which two ends of the lower movable member are mounted on two longitudinal side walls of the slider respectively, and a lower guiding roller fitted rotatably over the lower movable member and disposed within the central cavity.

2. The cable guiding device as set forth in claim 1, further including:

a left guiding roller rotatable around an axis thereof, in which upper and lower ends of the left guiding roller are mounted on top and bottom walls of the slider respectively; and a right guiding roller rotatable around an axis thereof, in which upper and lower ends of the right guiding roller are mounted on the top and bottom walls of the slider respectively, wherein the left and right guiding rollers are spaced a predetermined distance apart from each other in the longitudinal direction and disposed in front of the upper and lower guide members in the lateral direction, wherein a longitudinal size of the central cavity is larger than the predetermined distance.

3. The cable guiding device as set forth in claim 2, wherein axes of the upper and lower guide members are located in the same vertical plane, and axes of the left and right guiding rollers are located in the same longitudinal plane and parallel to each other.

4. The cable guiding device as set forth in claim 2, wherein two first lugs are formed on a front side of the top wall of the slider, extended forwardly in the lateral direction, and spaced apart from each other, two second lugs are formed on a front side of the bottom wall of the slider, extended forwardly in the lateral direction, and spaced apart from each other, and correspond to the two first lugs respectively, and upper ends of the left and right guiding rollers are mounted on the two first lugs and lower ends of the left and right guiding rollers are mounted on the two second lugs, respectively.

5. The cable guiding device as set forth in claim 1, wherein each of the upper and lower movable members includes a linear bearing.

6. The cable guiding device as set forth in claim 1, wherein the base includes:

a mounting plate, and first and second extending frames which are extended upwardly in the vertical direction from the mounting plate respectively and spaced apart from each other in the longitudinal direction, wherein two ends of each of the upper and lower guide members are mounted on the first and second extending frames respectively.

7. The cable guiding device as set forth in claim 6, further including:

first and second support frames which are mounted on the first and second extending frames respectively, wherein two ends of each of the upper and lower guide members are mounted on the first and second support frames respectively.

8. The cable guiding device as set forth in claim 1, further including a cable-pressing roller rotatably disposed in the central cavity of the slider along the longitudinally direction, and movable between a tension position at which the cable-pressing roller tensions the cable and a release position at which the cable-pressing roller release the cable.

9. The cable guiding device as set forth in claim 8, wherein a vertical groove is formed in each of the two longitudinal side walls of the slider, and two ends of the cable-pressing roller are supported in the vertical grooves respectively.

10. The cable guiding device as set forth in claim 9, wherein a plurality of recesses are formed in a side wall of each vertical groove and spaced apart from one another in the vertical direction, and wherein two ends of the cable-pressing roller are supported and held in the recesses respectively when the cable-pressing roller is located at the tension position and the release position.

* * * * *